United States Patent [19]

Tansi

[11] 4,203,638

[45] May 20, 1980

[54] ELECTRICAL RECEPTACLE AND GROUNDING STRIP THEREFOR

[75] Inventor: Hakki M. Tansi, Woodbury, N.Y.

[73] Assignee: Eagle Electric Mfg. Co., Inc., Long Island City, N.Y.

[21] Appl. No.: 950,172

[22] Filed: Oct. 10, 1978

[51] Int. Cl.[2] ..... H01R 3/06

[52] U.S. Cl. ..... 339/14 P; 174/51; 339/176 R

[58] Field of Search ..... 339/14 AN, 176 R, 195 A, 339/198 R; 174/51

[56] References Cited

U.S. PATENT DOCUMENTS

| | | | |
|---|---|---|---|
| 3,391,374 | 7/1968 | Schleicher | 339/14 R |
| 3,963,292 | 6/1976 | Smith | 339/14 R |

*Primary Examiner*—Roy Lake
*Assistant Examiner*—DeWalden W. Jones
*Attorney, Agent, or Firm*—Kirschstein, Kirschstein, Ottinger & Cobrin

[57] ABSTRACT

A multi-purpose grounding strip of one-piece metal construction is mounted on an electrical receptacle. The grounding strip includes a base portion, at least one female-type grounding socket portion having bent fingers for receiving a male-type ground prong of an electrical plug, a bent grounding lug portion having a hole for receiving a ground terminal screw, a bent automatic grounding portion having an aperture for receiving a mounting screw for mounting the receptacle in an electrical outlet box, a bent lip portion extending through a cutout formed in a mounting ear which overlies the aperture, and a bent tab portion which engages the receptacle. The bent lip and tab portions cooperate to prevent the automatic grounding portion from moving away from the ear in response to insertion of the mounting screw through the aperture. The receptacle is convertible to an isolated ground, hospital-type electrical receptacle by breaking a frangible zone which is located between the automatic grounding portion and the other bent portions.

32 Claims, 9 Drawing Figures

ELECTRICAL RECEPTACLE AND GROUNDING STRIP THEREFOR

BACKGROUND OF THE INVENTION

1. Field of the Invention

The present invention generally relates to electrical wiring devices commonly known as electrical receptacles which receive electrically-connecting devices known as plugs for the purpose of tapping off current for supplying numerous kinds of electrical appliances, tools and devices. More particularly, the present invention relates to grounded-type receptacles of the kind having three holes and three contacts, one of which is a ground-connected contact. Still more particularly, the present invention relates to grounding strips for such grounded-type receptacles.

2. Description of the Prior Art

A positive grounding path for grounded-type electrical receptacles has been obtained by connecting a jumper wire between the grounding lug contact, which is mounted on the receptacle, and the electrical outlet box, which is connected to earth ground via a grounded conduit. It has also been proposed to eliminate the jumper wire by using automatic grounding circuitry wherein the grounding path is obtained by electrically connecting a metal receptacle-mounting screw between a metal grounding clip attachment, which is separately connected to a grounding strip, and the metal electrical outlet box which is connected to earth ground. In this latter case, the ground connection is made from the grounded outlet box to the mounting screw and, thereupon, to the clip attachment and, in turn, to the grounding strip and, thereupon, to the grounding socket in which the ground plug is received.

All of the above-described grounding proposals generally meet current electrical code requirements; however, they have not proven to be altogether satisfactory in providing a reliable low impedance path to ground at a relatively low cost due to the fact that the electrical current must pass through a number of separate and discrete parts before it reaches earth ground. Each time the current traverses another discrete part, an undesirable voltage drop occurs across the electrical interconnection between each two successive parts, thereby resulting in a high impedance path to ground. For example, in the currently popular automatic grounding proposal described above, if the mounting screw is loosely fitted within its hole which is formed in the clip attachment, then a high resistance exists at this interconnection. Of course, the separate mountings of the clip to the grounding strip, and of the female-type grounding socket portion to the grounding strip both increase the resistance present in the grounding path. Still furthermore, the different electrical conductivities of the separate parts, due to the fact that the latter are generally constituted by different metals, likewise contributes to a poor grounding path.

Great heat and arcing might be created between any two such parts where the connection is poor due, for example, to ill-fitting parts or a poor rivet connection, or a poor soldering or weld-type connection, thereby possibly resulting in an electrical fire. An appliance plugged into this receptacle will not be provided with a good low resistance path to circuit ground, and if the casing of the appliance should be rendered electrically hot, it would pose a great safety hazard to those who are in close proximity to the appliance.

Another problem associated with prior art receptacles is that the automatic grounding portion, which underlies a mounting ear formed on the grounding strip, tends to be pulled away from the mounting ear when the mounting screw is inserted through the recess formed in the mounting ear and a juxtaposed recess formed in the automatic grounding portion. In order to eliminate such undesirable relative movement, the prior art has proposed using latches to restrain such movement; however, the restraining latches currently available have not proven to be altogether effective, particularly in cases where the installer repeatedly inserts and removes the mounting screw.

Still another drawback associated with prior art receptacles is that they do not possess sufficient mechanical strength to withstand structural damage, particularly to the grounding strip yoke. Typically, the receptacle is supported on the outlet box by a yoke which is connected at the underside of the bottom housing portion. When line cords are yanked suddenly, the receptacle may be pulled off its yoke.

Yet another drawback associated with prior art receptacles is that they are not readily convertible to isolated ground receptacles. In certain applications, typically in hospitals, it is desired to eliminate the possibility of stray currents affecting ultra-sensitive electronic equipment such as data-collecting systems, medical monitoring and analytical equipment. When equipment of this nature is grounded normally through the built-in ground, distorted signals can occur. Therefore, an additional, separate grounding wire is provided in hospitals to provide a "pure" or isolated ground path. This separate grounding path is typically run in the same raceway as the current-carrying conductors but is not a part of the normal grounding circuit. It is independent and is connected only to a suitable ground.

In order to make certain that the isolated ground path is independent from the normal grounding circuit through the outlet box, the prior art has proposed electrically-insulating material washers which surround the screw and which are placed underneath the automatic grounding portion to thereby prevent any electrical communication with the outlet box. However, such washers require separate manufacture with concomitant additional costs.

SUMMARY OF THE INVENTION

1. Objects of the Invention

Accordingly, it is the general object of the present invention to overcome the aforementioned drawbacks of the prior art.

An object of this invention is to provide a one-piece multi-purpose grounding strip which can be inexpensively formed of a single metal having a single electrical conductivity.

Another object is to provide a good low resistance path for the grounded socket in an electrical receptacle.

Still another object of this invention is to provide a more reliable and less expensive grounding assembly for an electrical receptacle.

A further object of this invention is to provide an improved grounding assembly which reduces the number of grounding circuit parts to a minimum.

An object of this invention is to effectively restrain relative movement between an automatic grounding portion of a grounding strip and a mounting ear of a receptacle, particularly during repeated insertions and/or removals of the mounting screw relative to the outlet box.

Another object of this invention is to increase mechanical strength of an electrical receptacle.

Still another object of this invention is to readily convert an electrical receptacle in situ to an isolated ground receptacle of the type commonly used in hospitals.

2. Features of the Invention

In keeping with these objects and others which will become apparent hereinafter, one feature of the present invention resides, briefly stated, in a one-piece multipurpose grounding strip for an electrical receptacle which comprises a generally planar, elongated base portion, a female-type grounding socket portion, a grounding lug portion, an automatic grounding portion, a lip portion, and an abutment tab portion, all of said portions being of one-piece construction and being constituted by the same metal material of substantially uniform electrical conductivity.

The socket portion has a pair of spaced-apart fingers for receiving therebetween a male-type ground prong of an electrical plug. The grounding lug portion has a hole for receiving a ground terminal fastener. The automatic grounding portion has an aperture for receiving a mounting fastener for mounting the electrical receptacle to an electrical outlet box. The lip portion has an upright and a transverse lip part operative for preventing the automatic grounding portion from moving relative to the electrical receptacle in response to insertion of the mounting fastener into the aperture. The abutment tab portion has an inclined abutment surface and is operative for cooperating with the lip portion to prevent the aforementioned relative movement between the automatic grounding portion and the receptacle. Each finger, the lug portion, the automatic grounding portion, the lip portion and the tab portion are each respectively bendable from an initial position, in which the respective element is substantially planar to the base portion, to, and is retained in, a bent position, in which the respective element is non-coplanar with the base portion. Put another way, the grounding strip is initially a generally flattened blank and, after the various bending steps have been performed, the grounding strip is erected into a three-dimensional configuration.

In accordance with the present invention, the unitary grounding strip is inexpensively formed of a single metal, preferably copper, having a uniform electrical conductivity. A good low resistance path is assured because the number of grounding circuit parts has been substantially reduced. No longer is the grounding circuit path comprised of different types of metals, such as aluminum, copper or steel, each having their own conductivity value. No longer are a plurality of interconnections required, each contributing to an increase in the overall resistance present in the grounding path.

In further accordance with the present invention, the upright lip part extends into a mounting cutout which is formed in a mounting ear which, in turn, is of one-piece with a top housing section of an electrical receptacle. The transverse lip part engages the upper abutment surface of the ear. The lip parts serve to reliably prevent the automatic grounding portion, which is of one-piece with the lip portion, from moving relative to the ear, particularly in response to insertion of the mounting fastener into the aperture of the automatic grounding portion. This feature overcomes the prior art latches which do not extend directly into the mounting cutout, but instead extend outwardly around the outer periphery of the mounting ear. The present invention has a much shorter moment arm as compared to the prior art latches, and this feature has been found to effectively restrain relative movement between the automatic grounding portion and the mounting ear.

In still further accordance with the present invention, a pair of mounting ears are formed of one-piece with the upper housing section. The outlet box mounting screws pass through the cutouts formed in the ears, and thus, any sudden yanking forces are transmitted directly to the upper housing section rather than to the mounting yoke as in prior art receptacles.

Yet another feature in accordance with the present invention is embodied in converting the receptacle into an isolated ground hospital-type receptacle. A frangible zone extends across the grounding strip between the automatic grounding portion and the base portion. A slot is located adjacent the frangible zone and is dimensioned to receive a breaking tool, such as a screwdriver. Upon turning the screw in the slot, the frangible zone is torn, and electrical communication between the automatic grounding portion and the base portion is interrupted. This means that the socket portion will not be grounded through the outlet box. Instead, an independent grounding line can be connected to the grounding strip to thereby ground the socket portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
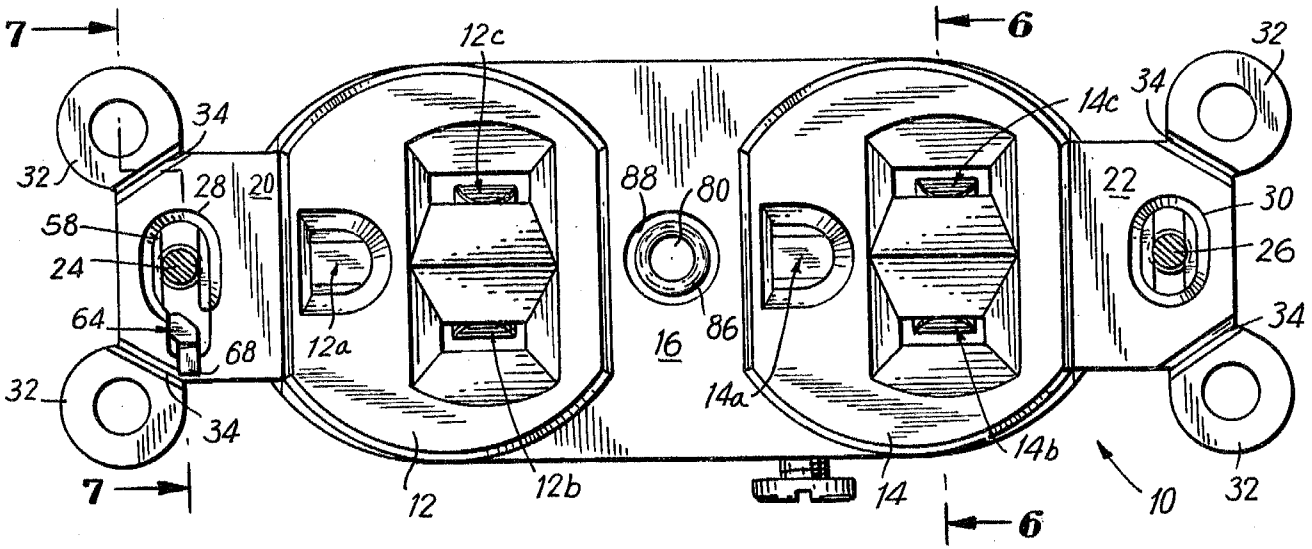
FIG. 1 is a top plan view of the electrical receptacle in accordance with the present invention.
Figure 2:
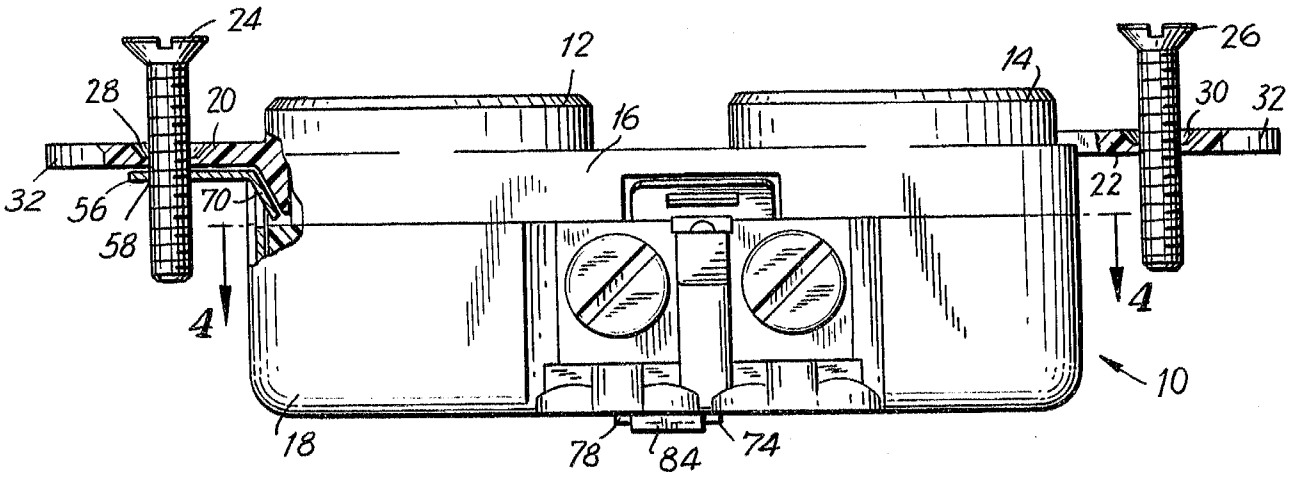
FIG. 2 is a partially sectioned front view of the electrical receptacle of FIG. 1.

Referring now to the drawings, the invention is illustrated in conjunction with an ordinary three-socket duplex wall receptacle 10. However, it should be understood that the invention can be used effectively with other electrical units such as single or multiple outlet electrical receptacles.

Each outlet 12, 14 has a pair of live female-type sockets 12*b*, 12*c* and 14*b*, 14*c*, and a ground female-type socket 12a, 14a. These sockets mate with non-illustrated, male-type prongs of an electrical plug, which plug is connected to the end of a three-wire cable that is attached to an electrical appliance. Each live socket is in the circuit path so that current flows to an activated appliance when the live plug prongs are properly inserted into the live sockets. Each ground socket is connected to a circuit ground, as will be shown herein, and provides the ground path for the casing of the appliance via a ground plug prong. This ground path is necessary as a precautionary measure to prevent the user of the appliance from receiving a dangerous electrical shock in the event that one of the hot power leads of the appliance becomes exposed and touches the casing of the appliance. Thus, this precautionary ground path provides a safety path which will prevent harm to the user.

Figures 5, 6, 7, 8, 9:
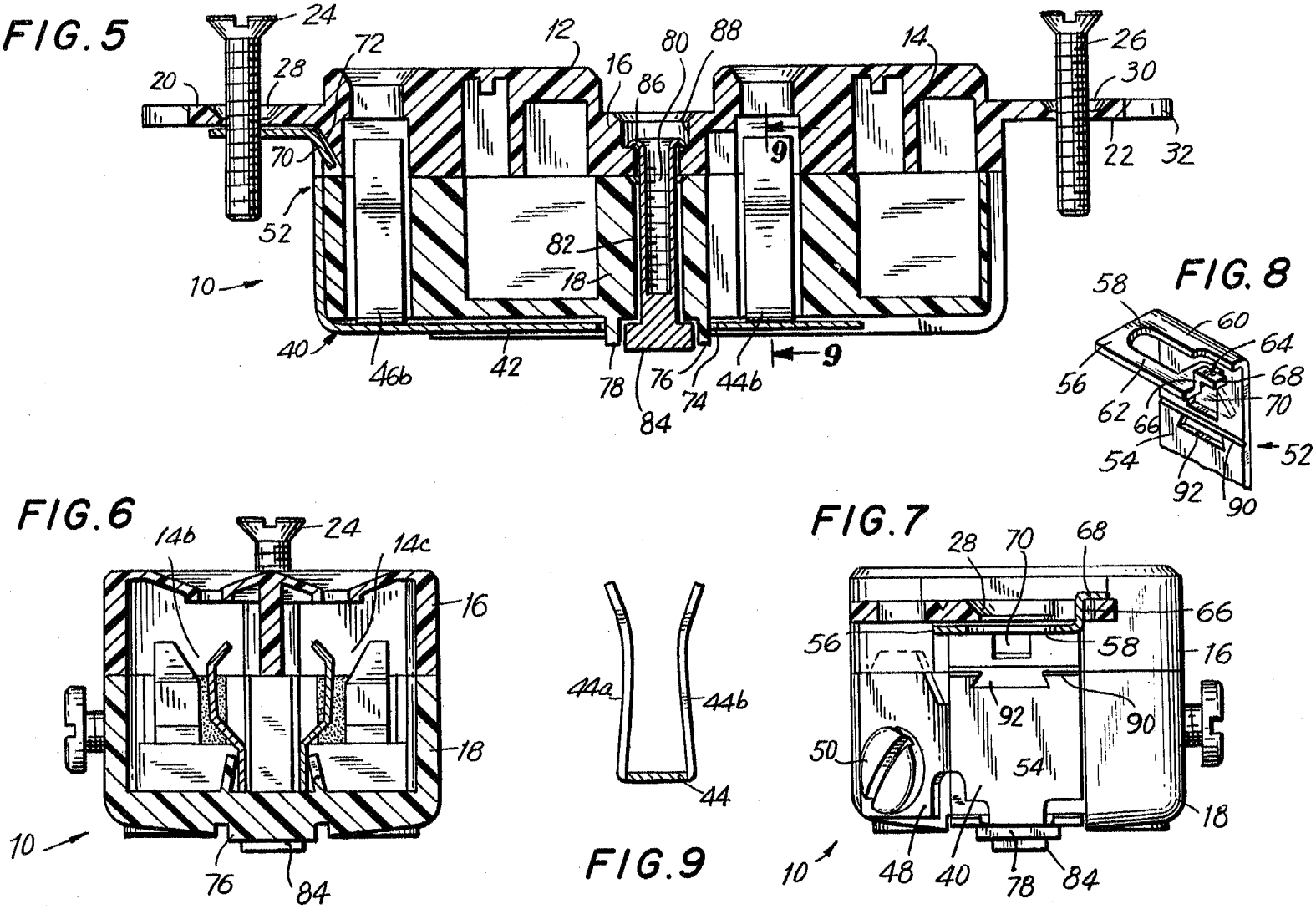
FIG. 5 is a sectional view of the receptacle as taken along line 5—5 of FIG. 4.
FIG. 6 is a sectional view of the receptacle as taken along line 6—6 of FIG. 1.
FIG. 7 is a sectional view of the receptacle as taken along line 7—7 of FIG. 1.
FIG. 8 is a broken-away perspective view of the one-piece grounding strip for use with the electrical receptacle of FIG. 1.
FIG. 9 is a sectional view of the receptacle as taken along line 9—9 of FIG. 5.

As best shown in FIG. 5, the receptacle 10 includes an upper and a lower housing portion or sections 16, 18, both of electrically-insulating material such as synthetic plastic material. A pair of mounting ears 20, 22 are formed of one-piece with the upper housing and project outwardly from opposite end regions of the latter. Outlet box fasteners are mounting screws 24, 26, respectively extend through mounting cutouts 28, 30 which are formed in ears 20, 22. The mounting screws 24, 26 are threaded into a non-illustrated electrical outlet or junction box for mounting the receptacle 10 on the latter in a conventional manner.

Electrically-insulating spacers 32 are detachably mounted on both mounting ears at opposite lateral sides of the latter along grooves or weakened zones 34. The detached spacers 32 are useful as shims or spacers between the mounting ears and their adjacent support, and they are used to properly position the receptacle to the outlet box so as to properly level the receptacle relative to the open side of the box, through which the receptacle faces.

Figure 3:
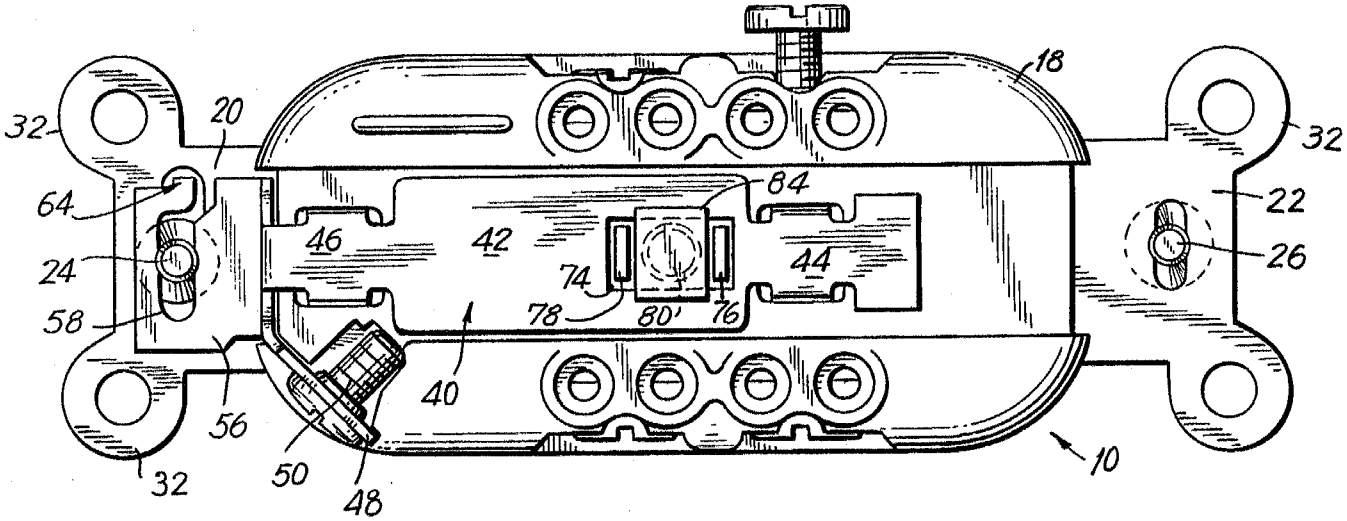
FIG. 3 is a bottom plan view of the electrical receptacle of FIG. 1.
Figure 4:
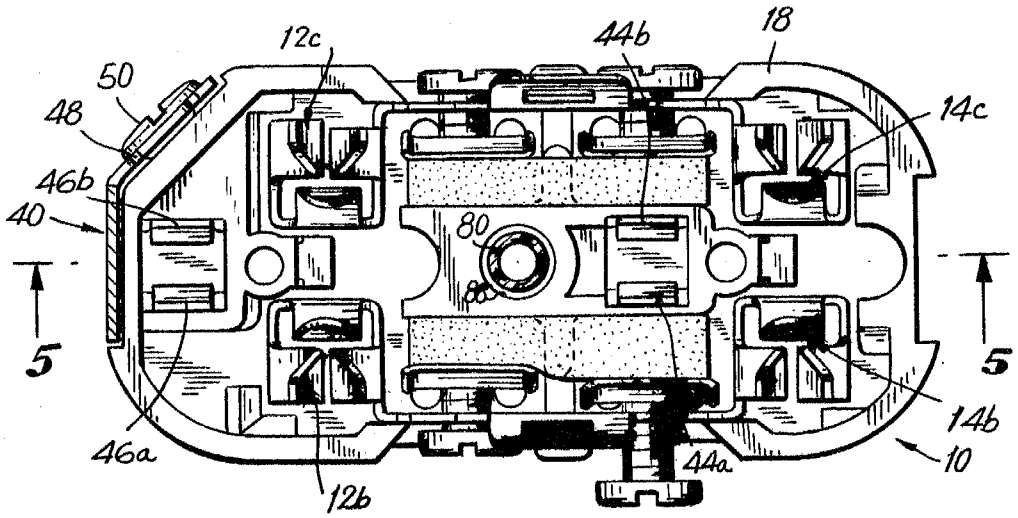
FIG. 4 is a sectional view of the receptacle as taken along line 4—4 of FIG. 2.

In accordance with the invention, a one-piece multipurpose grounding strip 40 is mounted on the receptacle. As shown in FIG. 3, the grounding strip 40 comprises a generally planar elongated base portion 42 mountable on the underside of the lower housing section 18. The strip 40 also comprises a pair of female-type grounding socket portions 44, 46 spaced apart of each other lengthwise along the strip. Each socket portion includes a pair of transversely spaced-apart fingers 44a, 44b, 46a, 46b, each pair constituting a spring-type clip (see FIG. 9) for receiving therebetween a male-type ground prong of an electrical plug. Each finger is bendable from an initial or unbent position, in which it is substantially coplanar with the base portion 42, to a final or bent position, in which it is substantially non-coplanar with, and preferably substantially normal to, base portion 42, and extends interiorly of the lower housing section 18. The strip 40 further comprises a grounding lug portion 48 having a hole for receiving a ground terminal fastener or screw 50 to which the aforementioned jumper wire may be connected in order to ground the strip 40 to the grounded outlet box. Lug portion 48 is substantially planar and is bendable from an initial or unbent position, in which it is substantially coplanar with the base portion, to a final or bent position, in which it is substantially non-coplanar with, and preferably generally normal to, the base portion 42. Bent lug portion 48, as best shown in FIGs. 4 and 7, extends exteriorly of lower housing section 18 and includes an angle, preferably an acute angle, of approximately 45°, relative to base portion 42.

The strip 40 further comprises an automatic grounding portion 52, as shown in isolation in FIG. 8, which includes an upright section 54 which shares a common edge with the base portion 42, and a flange section 56 which extends transversely and outwardly away from the upright section 54 for a distance sufficient to overlie the outlet box. The automatic grounding portion is bendable from an initial or unbent position, in which it is substantially coplanar with the base portion 42, to a bent position, in which the upright section is substantially normal, and in which the flange section is substantially parallel to, the base portion. The upright section lies exteriorly of the lower housing section, and the flange section lies underneath mounting ear 20.

The flange section 56 has flange wall portions which bound a circumferentially-incomplete or split aperture 58, which is generally juxtaposed with the cutout 28 of the ear 20. The flange wall portions include a pair of resilient arms 60, 62 at opposite sides of the aperture. Arm 62 is movable relative to arm 60 in response to insertion of the mounting screw 24 through the generally juxtaposed cutout 28 and aperture 58. Preferably, the aperture 58 is slightly laterally offset from cutout 28 such that arm 62 can be positively displaced during screw insertion. Thus, arm 62 serves as a resilient latch which reliably and affirmatively physically engages the threads of screw 24 to form an electro-mechanical connection therewith.

In order to prevent the flange section 56 from undesirably moving away from ear 20 during the aforementioned screw insertion, a bent lip portion 64 is formed of one-piece with the flange section 56. Bent lip portion 64 includes an upright lip part 66 and a transverse lip part 68. As shown in FIG. 7, the upright lip part extends into the cutout 28 of ear 20. The transverse lip part 68 engages the upper abutment surface of ear 20. This mounting arrangement, wherein the upright lip part 66 is surrounded by the flange wall means and extends into the cutout 28, provides for a minimum moment arm as measured in radial direction relative to the axis of screw 24. The strip 40 still further comprises an abutment tab portion 70 of one-piece with the automatic grounding portion 52. The tab portion 70 is substantially planar and bendable from an initial or unbent position, in which it is substantially coplanar with the base portion, and a bent position, in which it is inclined relative to the base portion. As shown in FIG. 5, the bent tab portion 70 is inclined relative to receptacle 10 and engages an inclined abutment surface 72 on the upper housing section 16 in the vicinity of the flange section 56. The bent tab portion 70 cooperates with the bent lip portion 64 to prevent undesirable relative movement of the flange section away from ear 20 during insertion of the screw 24 and particularly, during repetitive screw insertions and/or removals.

The base, socket, lug, automatic ground, lip and tab portions are all of one-piece construction and are constituted by the same metal material of substantially the same uniform electrical conductivity. Copper is preferably used for its good conductivity and resilient characteristics, although other metals can be similarly employed. All of the aforementioned portions originally lie in a generally flattened configuration and, after being bent in the orientations described above, they assume the illustrated three-dimensional configuration.

As best shown in FIGS. 3 and 5, the strip 40 also has a mounting slot 74 formed in the base portion. A pair of spaced-apart projections 76, 78 of one-piece with the lower housing section 18 extend from the bottom surface of the latter through the slot 74. A non-rotatable fastener 80 has a cylindrical body portion received in a passage 82 which is formed through both housing sections, and a head portion 84 which is mounted between projections 76, 78. The head portion 84 is polygonally shaped and has abutment surfaces which abut the projections 76, 78 in order to prevent turning of the fastener 80.

The upper part of fastener 80 is initially cylindrical and, after insertion of the body portion into passage 82, the upper part is upset, for example, by peening to thereby form a peened-over flange 86 in an enlarged bore 88 of the upper housing section 16. The upper and lower housing sections are thereby firmly secured to each other and, at the same time, the head portion 84 firmly secures the strip 40 to both housing sections. A non-illustrated wall plate screw, or the like, can now be threaded into the interior of fastener 80. The head portion 84 prevents rotation of the fastener during the turning of the wall plate screw into the fastener 80.

In order to convert receptacle 10 into an isolated ground or hospital-type electrical receptacle, break-away means are provided on the grounding strip 40 as shown in FIGS. 7 and 8. The break-away means includes a frangible zone 90 which extends transversely across the strip 40 between the automatic grounding portion 52 and the socket portions 44, 46. The frangible zone 90 is essentially a reduced wall thickness portion or groove which weakens this particular area of the strip and permits it to be torn lengthwise along the groove.

A tool recess 92 is formed in the groove and is dimensioned to receive the flat blade portion of a screwdriver or like tool. Upon turning the screwdriver in the recess 92, the frangible zone 90 tears, thereby interrupting electrical communication between the automatic ground portion and the socket portions.

As noted above, once electrical communication is broken between the automatic grounding portion and the outlet box, a separate and independent grounding wire may now be connected to the grounding strip, thereby providing the above-described "pure" or isolated ground path.

It will be understood that each of the elements described above, or two or more together, may also find a useful application in other types of constructions differing from the type described above.

While the invention has been illustrated and described as embodied in an electrical receptacle and grounding strip therefor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A one-piece multi-purpose grounding strip for electrical receptacles, comprising:

(a) a generally planar, elongated base portion mountable on an electrical receptacle;

(b) a female-type grounding socket portion of one-piece with said base portion and having a pair of spaced-apart fingers for receiving therebetween a male-type ground prong of an electrical plug, each finger being bendable between an initial and a bent position in which the respective finger is substantially coplanar and non-coplanar, respectively, relative to said base portion;

(c) a grounding lug portion of one-piece with said base portion and having a hole for receiving a ground terminal fastener, said lug portion being bendable between an initial and a bent position in which the lug portion is substantially coplanar and non-coplanar, respectively, relative to said base portion;

(d) an automatic grounding portion of one-piece with said base portion and having an aperture for receiving a mounting fastener for mounting the electrical receptacle to an electrical outlet box, said automatic grounding portion being bendable between an initial and a bent position in which the automatic grounding portion is substantially coplanar and non-coplanar, respectively, relative to said base portion;

(e) all of said portions being of one-piece non-riveted construction and being constituted by the same metal copper-based material of substantially uniform electrical conductivity; and (f) all of said bendable portions being bent from their respective initial positions in which the grounding strip has a generally flattened configuration to, and being retained in, their respective bent positions in which the grounding strip has a three-dimensional configuration.

2. The one-piece multi-purpose grounding strip as defined in claim 1; and further comprising means for mounting the grounding strip on the electrical receptacle, including wall means on said base portion for bounding a mounting slot, a pair of spaced-apart projections on the electrical receptacle and receivable in the mounting slot, means on the electrical receptacle for defining a passage therein which communicates with the mounting slot, and a non-rotatable fastener having a body portion receivable in the passage and a head portion which is mounted between said projections and which has abutment surfaces for engaging at least one of said projections in the event that the head portion is turned to thereby prevent the fastener from rotating.

3. The one-piece multi-purpose grounding strip as defined in claim 2, wherein the electrical receptacle has a pair of juxtaposed housing portions, and wherein said fastener extends through both of said housing portions and has a peened-over flange portion for securing said housing portions against movement relative to each other.

4. The one-piece multi-purpose grounding strip as defined in claim 1; and further comprising an additional female-type grounding socket portion substantially identical to said first-mentioned socket portion, both socket portions being spaced apart of each other lengthwise along said base portion.

5. The one-piece multi-purpose grounding strip as defined in claim 4, wherein each finger of said socket portions extends substantially normal to the base portion in said bent position of the respective finger.

6. The one-piece multi-purpose grounding strip as defined in claim 1, wherein said grounding lug portion is substantially planar and lies in a plane which extends substantially normal to, and which includes an angle relative to, said base portion in said bent position of the lug portion.

7. The one-piece multi-purpose grounding strip as defined in claim 1, wherein said automatic grounding portion includes an upright section which has a common bending edge with said base portion, and a flange section which extends transversely away from said upright section for a distance sufficient to overlie the electrical outlet box on which the electrical receptacle is mounted.

8. The one-piece multi-purpose grounding strip as defined in claim 7, wherein said upright section extends substantially normal to the base portion in said bent position of the automatic grounding portion, and wherein said flange section extends substantially parallel to the base portion in said bent position of the automatic grounding portion.

9. The one-piece multi-purpose grounding strip as defined in claim 7, wherein said flange section has flange wall portions which bound said aperture and form the same with a circumferentially-incomplete configuration, said flange wall portions including a pair of resilient arms located at opposite sides of said aperture and being movable apart of each other in response to insertion of the mounting fastener into said aperture.

10. The one-piece multi-purpose grounding strip as defined in claim 1, wherein all of said portions are constituted by copper.

11. The one-piece multi-purpose grounding strip as defined in claim 1, wherein said automatic grounding portion has a thickness dimension which is sufficient to impart resilience thereto and which is substantially of the same thickness dimension as all of the other portions of the strip.

12. An electrical receptacle of the type mountable on an electrical outlet box, comprising:

(a) a pair of elongated housing sections of electrically-insulating material and being juxtaposed one above another, one of said housing sections having mounting ears at opposite end regions thereof and being of one-piece with said one housing section, each ear having a mounting cutout in which a mounting fastener is inserted for mounting the electrical receptacle on the electrical outlet box;

(b) a one-piece multi-purpose ground strip, including (i) a generally planar, elongated base portion mountable on the other of said housing sections, (ii) a female-type grounding socket portion of one-piece with said base portion and having a pair of spaced-apart bent fingers for receiving therebetween a male-type ground prong of an electrical plug, each bent finger extending interiorly of said other housing section along a plane which is non-coplanar with said base portion, (iii) a bent grounding lug portion of one-piece with said base portion and having a hole for receiving a ground terminal fastener, said bent lug portion extending exteriorly of said other housing section along a plane which is non-coplanar with said base portion, (iv) a bent automatic grounding portion of one-piece with said base portion and having a bent flange section which extends exteriorly of said other housing section along a plane which is non-coplanar with said base portion, said bent flange section being juxtaposed with one of said mounting ears and having an aperture which is juxtaposed with said mounting cutout and which also receives the mounting fastener, and (v) all of said portions being of one-piece non-riveted construction and being constituted by the same copper-based metal material of substantially uniform electrical conductivity; and (c) mounting means for interconnecting said housing sections and said grounding strip.

13. The electrical receptacle as defined in claim 12, wherein said mounting means includes wall means on said base portion for bounding a mounting slot, a pair of spaced-apart projections on said other housing section and receivable in said mounting slot, wall means on both of said housing sections for defining a passage which extends through the latter and which communicates with said mounting slot, and a non-rotatable fastener having a body portion receivable in said passage, and a head portion which is mounted between said projections and which has abutment surfaces for engaging at least one of said projections in the event that said head portion is turned to thereby prevent said fastener from rotating.

14. The electrical receptacle as defined in claim 13, wherein said fastener extends through both of said housing sections and has a peened-over flange portion at said one housing section for securing said housing sections against movement relative to each other.

15. The electrical receptacle as defined in claim 12, and further comprising an additional female-type grounding socket portion substantially identical to said first-mentioned socket portion, both socket portions being spaced apart of each other lengthwise along said base portion.

16. The electrical receptacle as defined in claim 15, wherein each bent finger of said socket portions extends substantially normal to said base portion.

17. The electrical receptacle as defined in claim 12, wherein said bent lug portion is substantially planar and lies in a plane which extends substantially normal to, and which includes an angle relative to, said base portion.

18. The electrical receptacle as defined in claim 12, wherein said bent automatic grounding portion includes an upright section which extends transversely of said flange section, said upright section having a common edge with said base portion.

19. The electrical receptacle as defined in claim 18, wherein said upright section extends substantially normal to said base portion, and wherein said flange section extends substantially parallel to said base portion.

20. The electrical receptacle as defined in claim 12, wherein said flange section has flange wall portions which bound said aperture and form the same with a circumferentially-incomplete configuration, said flange wall portions including a pair of resilient arms located at opposite sides of said aperture and being movable apart of each other in response to insertion of the mounting fastener into said aperture.

21. The electrical receptacle as defined in claim 12, wherein said mounting ears overlie said flange sections and extend outwardly from the opposite end regions of said one housing section, each mounting ear having an upper abutment surface.

22. The electrical receptacle as defined in claim 12, wherein all of said portions are constituted by copper.

23. The electrical receptacle as defined in claim 12; and further comprising electrically-insulating spacers detachably connected to said mounting ears.

24. The electrical receptacle as defined in claim 12, wherein said bent flange section has a thickness dimension which is sufficient to impart resilience thereto and which is substantially of the same thickness dimension as the base, socket and lug portions of the strip.

25. The electrical receptacle as defined in claim 24, wherein each mounting ear has a thickness dimension which is greater than the thickness dimension of said bent flange section such that the electrical receptacle is supported on the outlet box by the relatively thicker and stronger mounting ears.

26. An electrical receptacle of the type mountable on an electrical outlet box, comprising:

(a) a pair of elongated housing sections of electrically-insulating material and being juxtaposed one above another, one of said housing sections having mounting ears at opposite end regions thereof, each ear having a mounting cutout in which a mounting fastener is inserted for mounting the electrical receptacle on the electrical outlet box;

(b) a one-piece multi-purpose ground strip, including
  (i) a generally planar, elongated base portion mountable on the other of said housing sections,
  (ii) a female-type grounding socket portion of one-piece with said base portion and having a pair of spaced-apart bent fingers for receiving therebetween a male-type ground prong of an electrical plug, each bent finger extending interiorly of said other housing section along a plane which is non-coplanar with said base portion,
  (iii) a bent grounding lug portion of one-piece with said base portion and having a hole for receiving a ground terminal fastener, said bent lug portion extending exteriorly of said other housing section along a plane which is non-coplanar with said base portion,
  (iv) a bent automatic grounding portion of one-piece with said base portion and having a bent flange section which extends exteriorly of said other housing section along a plane which is non-coplanar with said base portion, said bent flange section lying underneath one of said mounting ears and having an aperture which is juxtaposed underneath said mounting cutout and which also receives the mounting fastener, and
  (v) all of said portions being of one-piece construction and being constituted by the same metal material of substantially uniform electrical conductivity;

(c) mounting means for interconnecting said housing sections and said grounding strip; and (d) means for converting the electrical receptacle to an isolated ground electrical receptacle, said converting means including break-away means for interrupting electrical communication between said bent automatic grounding portion and the other portions of said grounding strip.

27. The electrical receptacle as defined in claim 26, wherein said break-away means includes a frangible zone extending transversely across said grounding strip intermediate said bent automatic grounding portion and said other portions of said grounding strip, and means for tearing said frangible zone including a recess for receiving a break-away tool.

28. A one-piece multi-purpose grounding strip for electrical receptacles, comprising:

(a) a generally planar, elongated base portion mountable on an electrical receptacle;

(b) a female-type grounding socket portion of one-piece with said base portion and having a pair of spaced-apart fingers for receiving therebetween a male-type ground prong of an electrical plug, each finger being bendable between an initial and a bent position in which the respective finger is substantially coplanar and non-coplanar, respectively, relative to said base portion;

(c) a grounding lug portion of one-piece with said base portion and having a hole for receiving a ground terminal fastener, said lug portion being bendable between an initial and a bent position in which the lug portion is substantially coplanar and non-coplanar, respectively, relative to said base portion;

(d) an automatic grounding portion of one-piece with said base portion and having an aperture for receiving a mounting fastener for mounting the electrical receptacle to an electrical outlet box, said automatic grounding portion being bendable between an initial and a bent position in which the automatic grounding portion is substantially coplanar and non-coplanar, respectively, relative to said base portion;

(e) all of said portions being of one-piece construction and being constituted by the same metal material of substantially uniform electrical conductivity;

(f) all of said bendable portions being bent from their respective initial positions in which the grounding strip has a generally flattened configuration to, and being retained in, their respective bent positions in which the grounding strip has a three-dimensional configuration; and (g) means for preventing said automatic grounding portion from moving relative to the electrical receptacle in response to insertion of the mounting fastener into said aperture, said preventing means including a bent lip portion of one-piece with said automatic grounding portion and having an upright lip part and a transverse lip part; and wherein the electrical receptacle has a mounting ear formed with a mounting cutout in which said upright lip part is received, said transverse lip part engaging the upper surface of said mounting ear to thereby prevent said automatic grounding portion from moving relative to said mounting ear.

29. A one-piece multi-purpose grounding strip for electrical receptacles, comprising:

(a) a generally planar, elongated base portion mountable on an electrical receptacle;

(b) a female-type grounding socket portion of one-piece with said base portion and having a pair of spaced-apart fingers for receiving therebetween a male-type ground prong of an electrical plug, each finger being bendable between an initial and a bent position in which the respective finger is substantially coplanar and non-coplanar, respectively, relative to said base portion;

(c) a grounding lug portion of one-piece with said base portion and having a hole for receiving a ground terminal fastener, said lug portion being bendable between an initial and a bent position in which the lug portion is substantially coplanar and non-coplanar, respectively, relative to said base portion;

(d) an automatic grounding portion of one-piece with said base portion and having an aperture for receiving a mounting fastener for mounting the electrical receptacle to an electrical outlet box, said automatic grounding portion being bendable between an initial and a bent position in which the automatic grounding portion is substantially coplanar and non-coplanar, respectively, relative to said base portion;

(e) all of said portions being of one-piece construction and being constituted by the same metal material of substantially uniform electrical conductivity;

(f) all of said bendable portions being bent from their respective initial positions in which the grounding strip has a generally flattened configuration to, and being retained in, their respective bent positions in which the grounding strip has a three-dimensional configuration; and (g) an abutment tab portion of one-piece with said base portion, said abutment tab portion being substantially planar and bendable between an initial position in which it is substantially coplanar with said base portion, and a bent position in which it is inclined relative to said base portion and relative to the electrical receptacle, said abutment tab portion having an abutment surface which engages the electrical receptacle in the vicinity of the automatic grounding portion to thereby prevent the latter from being moved relative to the electrical receptacle in response to insertion of the mounting fastener into said aperture.

30. A one-piece multi-purpose grounding strip for electrical receptacles, comprising:

(a) a generally planar, elongated base portion mountable on an electrical receptacle;

(b) a female-type grounding socket portion of one-piece with said base portion and having a pair of spaced-apart fingers for receiving therebetween a male-type ground prong of an electrical plug, each finger being bendable between an initial and a bent position in which the respective finger is substantially coplanar and non-coplanar, respectively, relative to said base portion;

(c) a grounding lug portion of one-piece with said base portion and having a hole for receiving a ground terminal fastener, said lug portion being bendable between an initial and a bent position in which the lug portion is substantially coplanar and non-coplanar, respectively, relative to said base portion;

(d) an automatic grounding portion of one-piece with said base portion and having an aperture for receiving a mounting fastener for mounting the electrical receptacle to an electrical outlet box, said automatic grounding portion being bendable between an initial and a bent position in which the automatic grounding portion is substantially coplanar and non-coplanar, respectively, relative to said base portion;

(e) all of said portions being of one-piece construction and being constituted by the same metal material of substantially uniform electrical conductivity; and (f) all of said bendable portions being bent from their respective initial positions in which the grounding strip has a generally flattened configuration to, and being retained in, their respective bent positions in which the grounding strip has a three-dimensional configuration; and (g) break-away means for interrupting electrical communication between said automatic grounding portion and the other portions of the grounding strip to thereby convert the latter for use with an isolated ground electrical receptacle, said break-away means including a frangible zone extending transversely across the grounding strip intermediate said automatic grounding portion and said other portions of the grounding strip, and means for tearing said frangible zone including a recess for receiving a breaking tool.

31. An electrical receptacle of the type mountable on an electrical outlet box, comprising:

(a) a pair of elongated housing sections of electrically-insulating material and being juxtaposed one above another, one of said housing sections having mounting ears at opposite end regions thereof, each ear having a mounting cutout in which a mounting fastener is inserted for mounting the electrical receptacle on the electrical outlet box, said mounting ears being of one-piece with said one housing section and extending outwardly from the opposite end regions of the latter, each mounting ear having an upper abutment surface;

(b) a one-piece multi-purpose ground strip, including (i) a generally planar, elongated base portion mountable on the other of said housing sections, (ii) a female-type grounding socket portion of one-piece with said base portion and having a pair of spaced-apart bent fingers for receiving therebetween a male-type ground prong of an electrical plug, each bent finger extending interiorly of said other housing section along a plane which is non-coplanar with said base portion, (iii) a bent grounding lug portion of one-piece with said base portion and having a hole for receiving a ground terminal fastener, said bent lug portion extending exteriorly of said other housing section along a plane which is non-coplanar with said base portion, (iv) a bent automatic grounding portion of one-piece with said base portion and having a bent flange section which extends exteriorly of said other housing section along a plane which is non-coplanar with said base portion, said bent flange section lying underneath one of said mounting ears and having an aperture which is juxtaposed underneath said mounting cutout and which also receives the mounting fastener, and (v) all of said portions being of one-piece construction and being constituted by the same metal material of substantially uniform electrical conductivity;

(c) mounting means for interconnecting said housing sections and said grounding strip; and (d) means for preventing said bent automatic grounding portion from moving relative to said one mounting ear in response to insertion of the mounting fastener into said aperture, said preventing means including a bent lip portion of one-piece with said bent flange section and having an upright lip part and a transverse lip part, said upright lip part extending into the mounting cutout of said one mounting ear, and said transverse lip part latchingly engaging the upper abutment surface of said one mounting ear to thereby prevent said bent flange section from moving relative to said one mounting ear.

32. An electrical receptacle of the type mountable on an electrical outlet box, comprising:

(a) a pair of elongated housing sections of electrically-insulating material and being juxtaposed one above another, one of said housing sections having mounting ears at opposite end regions thereof, each ear having a mounting cutout in which a mounting fastener is inserted for mounting the electrical receptacle on the electrical outlet box;

(b) a one-piece multi-purpose ground strip, including (i) a generally planar, elongated base portion mountable on the other of said housing sections, (ii) a female-type grounding socket portion of one-piece with said base portion and having a pair of spaced-apart bent fingers for receiving therebetween a male-type ground prong of an electrical plug, each bent finger extending interiorly of said other housing section along a plane which is non-coplanar with said base portion, (iii) a bent grounding lug portion of one-piece with said base portion and having a hole for receiving a ground terminal fastener, said bent lug portion extending exteriorly of said other housing section along a plane which is non-coplanar with said base portion, (iv) a bent automatic grounding portion of one-piece with said base portion and having a bent flange section which extends exteriorly of said other housing section along a plane which is non-coplanar with said base portion, said bent flange section lying underneath one of said mounting ears and having an aperture which is juxtaposed underneath said mounting cutout and which also receives the mounting fastener, and (v) all of said portions being of one-piece construction and being constituted by the same metal material of substantially uniform electrical conductivity;

(c) mounting means for interconnecting said housing sections and said grounding strip; and (d) a substantially planar, bent abutment tab portion of one-piece with said base portion, said bent tab portion extending exteriorly of said housing sections and at an angle relative to the latter and said base portion, said bent tab portion having an abutment surface which engages the electrical receptacle in the vicinity of said bent automatic ground portion to thereby prevent the latter from being moved relative to the electrical receptacle in response to insertion of the mounting fastener into said aperture.

* * * * *